US010145057B2

(12) United States Patent
Goble et al.

(10) Patent No.: US 10,145,057 B2
(45) **Date of Patent: *Dec. 4, 2018**

(54) MOUNTABLE LINT VACUUM DEVICE AND NON-MARRING NOZZLE

(71) Applicants: Gwynn J. Goble, Marysville, WA (US); Julia A. Goble, Marysville, WA (US)

(72) Inventors: Gwynn J. Goble, Marysville, WA (US); Julia A. Goble, Marysville, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/612,014

(22) Filed: Jun. 2, 2017

(65) Prior Publication Data

US 2017/0268157 A1 Sep. 21, 2017

Related U.S. Application Data

(62) Division of application No. 14/731,962, filed on Jun. 5, 2015, now Pat. No. 9,695,545.

(51) Int. Cl.
*D06F 58/22* (2006.01)
*A47L 9/00* (2006.01)
(Continued)

(52) U.S. Cl.
CPC ..... *D06F 58/22* (2013.01); *A47L 9/00* (2013.01); *A47L 9/0036* (2013.01);
(Continued)

(58) Field of Classification Search
CPC . A47L 9/02; A47L 9/00; A47L 9/0686; A47L 9/242; A47L 7/0009; A47L 9/0673;
(Continued)

(56) References Cited

U.S. PATENT DOCUMENTS 4,553,284 A * 11/1985 Strumbos ..... A47L 9/02 15/414
5,050,266 A 9/1991 Schneider
(Continued)

FOREIGN PATENT DOCUMENTS

WO WO 91/11954 8/1991
WO WO 2008/111891 9/2008

OTHER PUBLICATIONS

3M Electronics Vacuum Model 497AJM; https://www.farnell.com/datasheets/716856.pdf; 3M Electronic Solutions Division, Static Control Products, 2009, USA.
(Continued)

*Primary Examiner* — Robert Scruggs

(57) ABSTRACT

A non-marring nozzle attachment that may be used with a vacuum device to clean delicate surfaces such as lint screens. The non-marring nozzle attachment may use a non-marring material with a beveled surface to allow for a vacuum to safely and effectively clean delicate surfaces. The non-marring nozzle attachment may further include spaced slits to allow for more intimate contact between the nozzle tip and a surface to be cleaned. The vacuum device may be mounted near the desired area of use to a variety of rigid surfaces without having to penetrate the rigid surface with nails or screws.

20 Claims, 10 Drawing Sheets

(51) Int. Cl.
*A47L 9/06* (2006.01)
*A47L 9/24* (2006.01)
*A47L 9/28* (2006.01)

(52) U.S. Cl.
CPC ..... *A47L 9/0673* (2013.01); *A47L 9/0693* (2013.01); *A47L 9/242* (2013.01); *A47L 9/2857* (2013.01)

(58) Field of Classification Search
CPC ... A47L 9/068; A47L 9/10; A47L 9/24; A47L 9/0036; A47L 9/0693; A47L 9/2857; D06F 58/22
See application file for complete search history.

(56) References Cited

U.S. PATENT DOCUMENTS

| | | | | |
|---|---|---|---|---|
| 6,223,387 | B1 | 5/2001 | Anderson | |
| 6,481,047 | B1 | 11/2002 | Schaefer | |
| 6,735,810 | B2 | 5/2004 | Najm et al. | |
| 7,231,686 | B1 | 6/2007 | Matheney | |
| 7,418,763 | B2 | 9/2008 | Shaver et al. | |
| 9,695,545 | B2 * | 7/2017 | Goble | A47L 9/00 |
| 2004/0216264 | A1 * | 11/2004 | Shaver | A47L 5/14 15/344 |
| 2011/0088204 | A1 | 4/2011 | Kim | |
| 2011/0219571 | A1 | 9/2011 | Dyson et al. | |

OTHER PUBLICATIONS

UZ 964 Hip Vac; https://www.kenteuroclean.com/products/canistervacuums/uz_964_hip_vac.aspx; Kent, Nilfisk—Advance Group, accessed May 27, 2015.

Metro Vac N Bio Vacuum; https://www.metrovacworld.com/Vac_N_Bio_Automotive_VNB-4AFBR/overview; Metropolitan Vacuum Cleaner Company, Inc., USA, accessed May 27, 2015.

Autobahn Max Vac 5.0 Hp; http://www.autogeek.net/autobahn-garage-vacuum.html, Autogeek.net-Autogeek, Your Car Wax Superstore, USA, accessed May 27, 2015.

Bissell Garage Pro Wet/Dry Vacuum; http://www.bissell.com/garage-pro-wet-dry-vacuum/; Bissell, Michigan, USA, accessed May 27, 2015.

VacuMaid GV30; http://www.vacumaid.com/product-category/garage-vac/; VacuMaid, Lindsay Manufacturing, Inc., Oklahoma, USA, accessed May 27, 2015.

Shop-Vac® Wall Mount Vacuum; http://www.amazon.com/SHO3942010-SHOPVAC-Wall-Mount-Vac/dp/B00C3ILCB8; Shop-Vac Corporation, Pennsylvania, USA, accessed May 27, 2015.

InterVac Systems; http://www.intervacdesign.com.au/; InterVac Design Corp., accessed May 27, 2015.

Lint Lizzard Vacuum Attachment: http://www.bedbathandbeyond.com/store/product/lint-lizard-lint-trap-cleaning-tool/1040149912, accessed May 27, 2015.

Linteater Dryer Vent Cleaning; http://www.lowes.com/pd_37653-59625-RLE202-L_0_?productId=3465404; accessed May 27, 2015.

Walter Drake's Vac Attachment; http://www.wdrake.com/buy-dryer-lint-vacuum-attachment-332559; Walter Drake, Wisconsin, USA, accessed May 27, 2015.

VaccUFlex, http://www.amazon.com/VaccUFlex%C2%AE-vacuum-attachment-kit-VaccuFlex%C2%AE/dp/B006T8B8RQ; accessed May 27, 2015.

Dundas Jafine DryerLint Removal Kit, http://www.dundasjafine.com/products/17-accessories/131-proclean-dryer-lint-removal-kit.html, New York, USA, accessed May 27, 2015.

* cited by examiner 400
404
402
406
414
405
401
403
410
412
408

MOUNTABLE LINT VACUUM DEVICE AND NON-MARRING NOZZLE

BACKGROUND

Many households in the United States have a clothes dryer that uses a lint screen to prevent lint from entering a dryer exhaust vent hose. With each load, lint builds on the lint screen and the user must continually clean it. Typical vacuum cleaner devices are not practical for cleaning lint screens because they are bulky and not conveniently located close enough to the lint screen. Typical vacuum cleaner devices also use rigid materials, such as hard plastic, which can easily result in damage to the lint screen (which is normally made of metal). Additionally, using the typical vacuum cleaner on a fine mesh surface results in the production of loud, undesirable whistling sounds while cleaning. These unique problems create a need for an improved lint vacuum device locatable near a lint screen and also a need for a suitable nozzle for cleaning a lint screen.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In some embodiments, a device for cleaning a lint screen of a clothes dryer is provided. The device comprises a vacuum hose, a non-marring nozzle, and a main body assembly. The vacuum hose comprises a first end configured to allow communication with the main body assembly, and a second end configured to mate with a hose adapter. The non-marring nozzle comprises a non-marring nozzle attachment and a hose adapter. The hose adapter comprises an upstream adapter end and a downstream hose adapter end that can be configured to mate with the second end of the vacuum hose to allow communication between the nozzle and the vacuum hose. The main body assembly may be configured to allow communication with the vacuum hose and may include a directional discharge nozzle that can be configured to allow for communication with an area external to the device.

In some embodiments, a non-marring nozzle attachment for a vacuum cleaner hose is provided. The non-marring nozzle attachment comprises a hollow member comprising a non-marring flexible material with a downstream end configurable to mate with a vacuum cleaner hose by various mechanisms, and a an upstream end that may have one or more slits that extend around the upstream surface of the upstream end to form one or more fingers.

In some embodiments, a kit for cleaning a lint screen of a clothes dryer is provided. The kit comprises a vacuum device, a vacuum hose configured to couple with the vacuum device, a non-marring nozzle configured to couple with the vacuum hose, and a base plate assembly configured to mount the vacuum device to a rigid surface.

DETAILED DESCRIPTION

Figure 1:
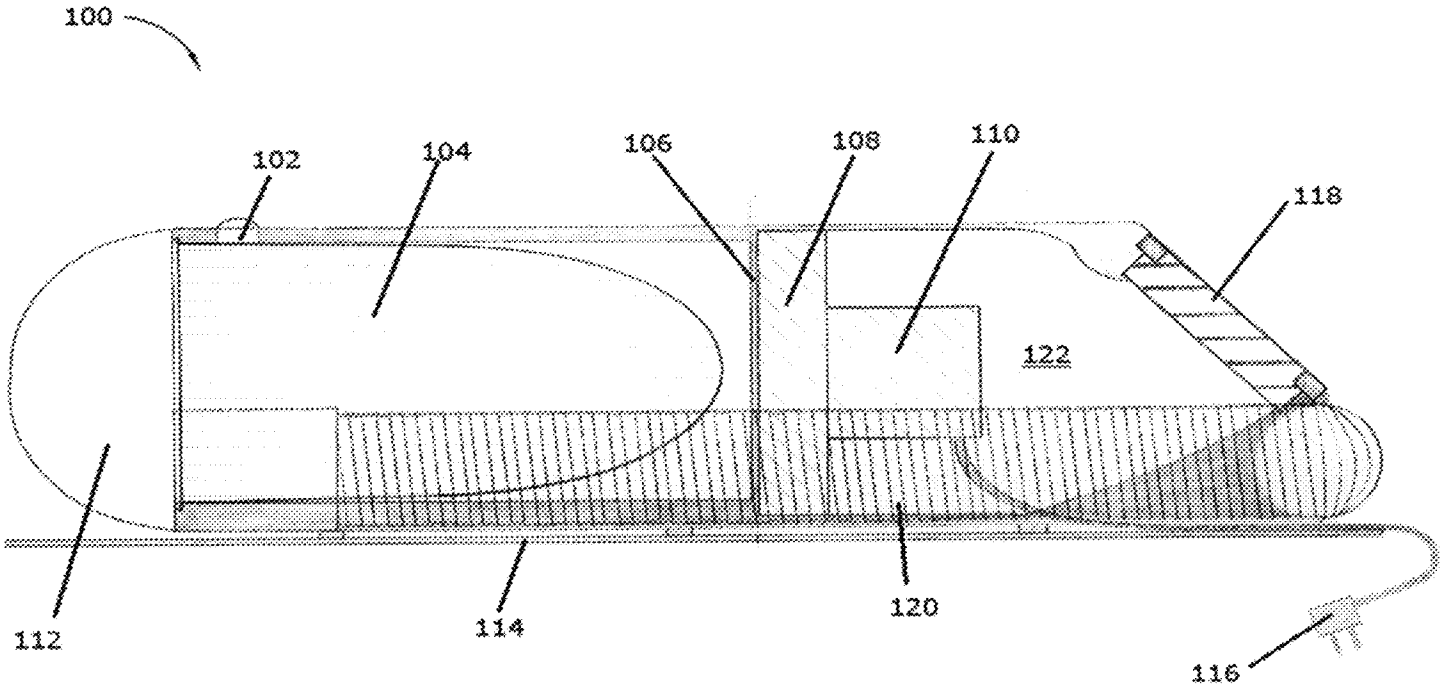
FIG. 1 shows a partial cutaway view of an illustrative example of an embodiment having the inlet hose, end housing assembly, internals of the main body assembly, directional discharge nozzle and base plate assembly.

Some embodiments of the present disclosure provide a vacuum device that is small, compact, powerful, and able to be mounted on any rigid surfaces around the household and working areas. Some embodiments of the present disclosure may be particularly helpful to clean household and working areas including, but not limited to, lint screens, kitty litter boxes, metal shavings, hair clippings, and woodwork surfaces. The present disclosure may also be particularly helpful in other applications which require cleaning of a delicate, easily damaged surface (e.g., a lint screen, fine mesh surface, delicate clothing, and more).

Some embodiments of the present disclosure provide a non-marring nozzle attachment specifically adapted for cleaning delicate surfaces without causing damage. Through use of a non-marring nozzle attachment, the present disclosure allows interaction with delicate surfaces, such as lint screens, with limited risk of causing damage. Previously existing rigid nozzles create a loud whistling noise when cleaning delicate surfaces such as lint screens, which can be irritating to the user and limit the hours that a cleaning device can be used. In some embodiments, the present disclosure solves this problem by providing a non-marring nozzle attachment whose surface may be beveled and contain slits so as to allow more intimate contact between the non-marring nozzle attachment and cleaning surface.

Some embodiments of the present disclosure are small and compact in size, while also being powerful enough to adequately clean a given surface. One way the present disclosure accomplishes this task is through use of the directional discharge nozzle, which allows effluent air to be exhausted from the vacuum device in a deliberate direction and thus limits the back pressure placed on the motor. As a result, the vacuum device may be installed with a more powerful motor than otherwise would be possible in vacuum devices not having a discharge nozzle. Such a configuration may increase the suction pressure at the non-marring nozzle inlet, and make more effective use of the motor. Some embodiments of the present disclosure are thus small and compact in size, while also being powerful enough to clean surfaces or debris that otherwise would not be possible with conventional vacuum devices.

Some embodiments of the present disclosure may also be used to clean household and working areas even when those areas are located in positions where the discharge airflow might be directly in the line-of-sight of the surface to be cleaned. The directional discharge nozzle may be rotated 360 degrees and thus allow the user to direct effluent airflow in a desired direction (e.g., away from the area being cleaned).

Some embodiments of the present disclosure may also be used to provide the ability to mount the vacuum device on a variety of rigid surfaces, such as a wall or laundry machine surface, without having to penetrate the rigid surface with nails or screws. The present disclosure may also present users with the ability to easily mount the vacuum device near the desired area of use, at a height desired by the user. In addition, in some embodiments, a base plate assembly may be securable to a rigid surface using adhesive tape, and the vacuum device may further be securable to the base plate assembly. In some embodiments, the vacuum device may be used while the device is mounted and/or can be easily detached so as to be used in another area. In some embodiments, the base plate assembly may also be easily removed and remounted in another desired area.

FIG. 1 shows a partial cutaway view of an illustrative example of an embodiment having the inlet hose, end housing assembly, internals of the main body assembly, directional discharge nozzle and base plate assembly. In an embodiment, the vacuum cleaner may be operable to draw air through a vacuum hose 120 to an end housing assembly 112. The air may then enter a filter chamber 104 stored in a main body assembly 100 section, after which the air may pass through a diffuser plate 106, impeller 108, and motor 110. In some embodiments, the impeller 108 and motor 110 may be housed in an impeller/motor chamber 122, which may be part of the main body assembly 100. After passing through the impeller 108, the effluent air may pass through the directional discharge nozzle 118 to an area external to the vacuum cleaner. In some embodiments, the directional discharge nozzle 118 allows communication between the main body assembly 100 and the area external to the vacuum cleaner.

In some embodiments, an electrical cord 116 connects the motor 110 to an electrical source (outlet). The electrical cord 116 may be accessible from the bottom of the impeller/motor chamber 122 of the main body assembly 100 and may be routed between the bottom of the main body assembly 100 and top of the base plate 114. The electrical cord 116 may also be retractable or wrapped around the base plate assembly 114. An ON/OFF switch 102 is mounted on the top surface of the main body assembly 100 to either connect or disconnect power from the motor 110 to the electrical source (outlet).

Figure 2:
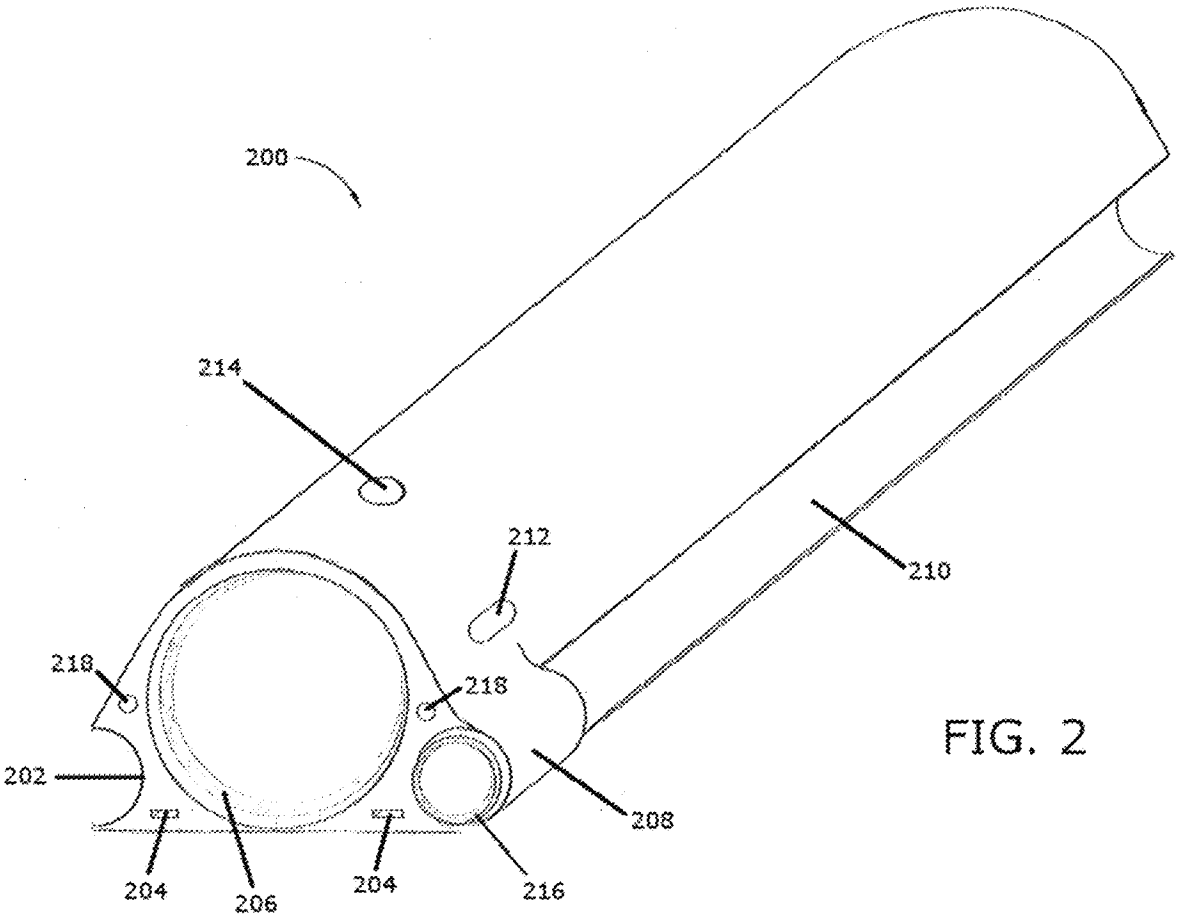
FIG. 2 shows a perspective view of an illustrative example of an embodiment of a main body assembly with the end housing assembly detached.

FIG. 2, in accordance with an embodiment, shows a perspective view of an illustrative example of a main body assembly 200 with an end housing assembly detached. An attachment cleat 202 may be formed into the side of the main housing assembly 200 and securely hold a nozzle through positive compression between the inner diameter of the attachment cleat 202 and the outer diameter of the nozzle. In some embodiments, the nozzle referred to will be equivalent to the non-marring nozzle 302 described below in connection with FIG. 3.

A vacuum hose (such as the vacuum hose described above in connection with FIG. 1), when not in use, may be held in the formed concave hose cradle channel 210 of the main body assembly 200. The hose cradle channel 210 may extend from the attachment cleat 202 around the lower portion of the main body assembly 200 to the hose end securing sleeve 208. In some embodiments, the hose end securing sleeve 208 may be part of the uniform mold that forms the main body assembly 200. The downstream end of vacuum hose that is secured to the main body assembly 200 by the hose end securing sleeve 208 may comprise a male-end hose union sleeve 216 that mates with a similarly sized female-end port of an end housing assembly. In some embodiments, this female-end port may be equivalent to the hose union port 608 of the end housing assembly 600 as described below in connection with FIG. 6. As such, the male-end hose union sleeve 216 may protrude from the downstream end of a vacuum hose to ensure a positive connection to the female-end port.

Similarly, the female-end filter union port 206 of the main body assembly 200 may be mated to a male-end chamber of an end housing assembly to form a positive connection. In some embodiments, this male-end chamber may be equivalent to the male-end filter chamber sleeve 606 of the end housing assembly 600, as described below in connection with FIG. 6. As such, the male-end chamber may protrude from the end housing assembly to ensure a positive connection to the female-end filter union port 206 of the main body assembly 200. The end housing assembly may be further secured to the main body assembly 200 by inserting protruding posts into the latch assembly ports 218. In some embodiments, these protruding posts may be equivalent to the latch posts 604 described below in connection with FIG. 6. In some embodiments, the end housing assembly may be detached from a main body assembly 200 by pushing two release buttons 212 located on the main body assembly 200 (second end housing release button not shown in FIG. 2). Pushing the release button 212 mechanically releases the end housing assembly. In some embodiments, the main body assembly 200 may also contain slide lock channels 204, which may be used to mount the vacuum cleaner on a rigid surface. The main body assembly 200 may also have an ON/OFF switch 214.

Figure 3:
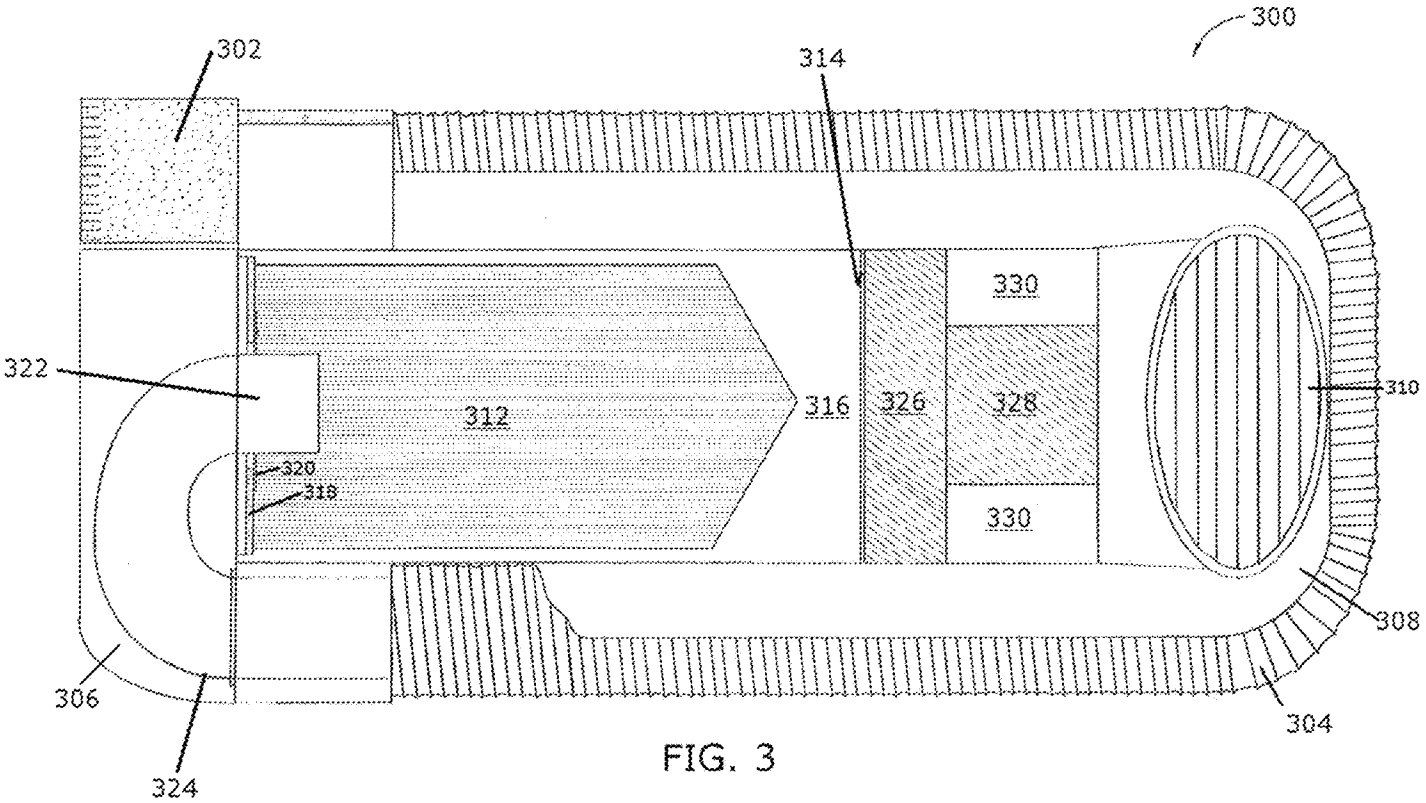
FIG. 3 shows a top-down cutaway view of an illustrative example of an embodiment which shows the inlet hose, internals of the end housing assembly, internals of the main body assembly, directional discharge nozzle, and union of the inlet hose to the end housing assembly.

FIG. 3 shows a top-down cutaway view of an illustrative example of a vacuum device 300 embodiment. The embodiment illustrated in FIG. 3 shows the inlet hose 304, internals of the end housing assembly 306, internals of the main body assembly 308, and directional discharge nozzle 310. The embodiment also highlights the union of the inlet hose 304 to the end housing assembly 306. In some embodiments, the vacuum device 300 may have a filter bag 312 to capture the particulate matter and allow cleaned air to pass through the walls of the filter bag 312 to the diffuser plate 314. The filter bag 312 is located within the filter assembly 316 and is secured in place by installing the end housing assembly 306 onto the main body assembly 308. In some embodiments, the filter bag 312 itself may comprise micro filtration capabilities. In some embodiments, the filter bag 312 may be a micro filter bag.

When dirty, the filter bag 312 may be accessed and replaced by removing the end housing assembly 306. Once the end housing assembly 306 is removed, the filter bag 312 can be easily accessed and removed. The circular cardboard plate 318 of the filter bag 312 has an opening in the center that contains a flexible rubber seal 320 to ensure there is no leakage, or minimal leakage, of air when mated with the end housing assembly 306. A second filter bag 312 can be inserted into the filter assembly 316 and the end housing assembly 306 can be installed or reinstalled by aligning the male-end filter assembly union sleeve 322 of the end housing assembly 306 with the respective female-end filter port of the main body assembly 308 and aligning the female-end hose union port 324 of the end housing assembly 306 with the respective male-end hose union sleeve of the main body assembly 308 and pressing together until latched. Such a configuration, where the end housing assembly 306 attaches to the main body assembly 308 using at least one end housing male-end port and one female-end union, may be used to ensure proper mating of the end housing assembly 306 with the main body assembly 308 (e.g, the installation can only be properly aligned in one manner, the structural integrity of the installed device can be better maintained, and so on). In some embodiments, the filter bag 312 used in the vacuum device 300 may be an industry standard filter bag 312 available in various filtration coefficients.

In some embodiments, filtered air exiting the filter bag 312 flows to the diffuser plate 314, which may be rigidly positioned upstream of the impeller 326 and motor 328. The motor 328 may, for example, include high-suction motors having an amperage rating of up to 10 amps. A function of the diffuser plate 314 in some embodiments is to separate the filter assembly 316 from the impeller/motor chamber 330, and thus prevent objects from entering and damaging the impeller 326. The diffuser plate 314 may also provide a safety feature of preventing human body parts from coming in contact with the impeller/motor chamber 326. In an embodiment, the diffuser plate 314 may be made from a thin metal material (e.g., a sheet of steel), a rigid plastic (e.g., a polycarbonate), or any combination thereof.

Figures 4A, 4B, 4C:
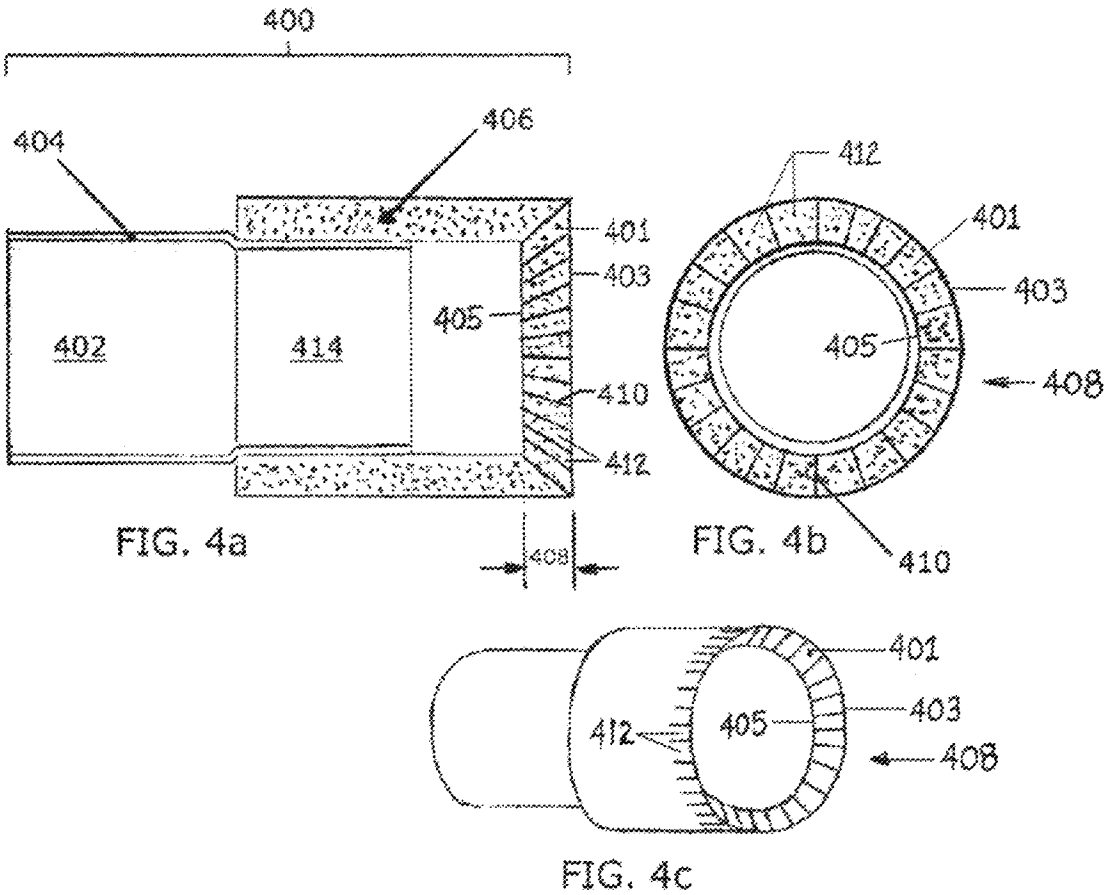
FIG. 4*a* shows a cross-sectional side profile view of an illustrative example of an embodiment of the non-marring nozzle.
FIG. 4*b* shows a end view of an illustrative example of an embodiment of the non-marring nozzle.
FIG. 4*c* shows a partial perspective view of an illustrative example of an embodiment of the non-marring nozzle.

FIG. 4*a* illustrates an example cross-sectional side profile view an embodiment of a non-marring nozzle 400. In one embodiment, the non-marring nozzle 400 comprises a non-marring nozzle attachment 406 and a hose adapter 404. In some embodiments, the hose adapter 404 is a rigid cylindrical hollow sleeve that may be composed of a rigid plastic material and can mate to standard vacuum hose ends used in industry (e.g., 1.25" diameter type hoses). In other embodiments, the hose adapter 404 may mate with hose ends of different diameter sizes. The downstream end 402 of the hose adapter 404 is capable of being mated to a stretchable vacuum hose (e.g., the hose described above in connection with FIG. 1). The opposite end of the hose adapter, referred to as the upstream end 414 of the hose adapter 404, is mated with the non-marring nozzle attachment 406. The upstream end 414 of the hose adapter 404 and the non-marring nozzle attachment 406 may be removably mated in any suitable manner, including mating through a tapered friction fit, using magnet or magnetic attachments, using mechanical clasps, and so on. In some embodiments, the non-marring nozzle attachment 406 and hose adapter 404 are affixed in a more permanent manner (e.g., wherein the non-marring nozzle attachment 406 and hose adapter 404 are glued or welded together). The inner diameter of the upstream end 414 of the hose adapter 404 may be less than that of the downstream end 402 of the hose adapter 404 so as to allow the non-marring nozzle attachment 406 to mate via a tapered friction fit. In one embodiment, the hose adapter 404 is 2.5" long in which the downstream end 402 of the hose adapter 404 is 1.5" long and the upstream end 414 of the hose adapter 404 is 1" long. In other embodiments, the upstream end 414 and downstream end 402 of the hose adapter 404 may be longer or shorter depending on the need of the user.

In some embodiments, the non-marring nozzle attachment 406 may be a cylindrical hollow form that can be mated to the upstream end 414 of the hose adapter 404. In other embodiments, the shape of the hollow form contact surface area may also be of different shapes, such as a rectangular form, oval form, or square form, In one embodiment the non-marring nozzle attachment 406 encases the upstream end 414 of the hose adapter 404 such that the hose adapter 404 may extend at least partially through the non-marring nozzle attachment 406. Here, at least partially through shall mean that the upstream end 414 of the hose adapter 404 will cross the plane of the downstream end of the non-marring nozzle attachment 406.

In some embodiments, the non-marring nozzle attachment 406 may be made of a flexible, resilient material such as closed cell polyethylene material. In some embodiments, the non-marring nozzle attachment 406 may be made of a material having an outer diameter and inner diameter that is sized according to the user's particular need. In one embodiment, the non-marring nozzle attachment 406 may have a 1.75" outer diameter and a 1.25" inner diameter. The non-marring nozzle attachment 406 may similarly have a wall thickness that is sized according to the user's particular need.

In some embodiments, the upstream inlet end portion 408 of the non-marring nozzle attachment 406 is the nozzle surface in contact with the surface to be cleaned. This upstream inlet end portion 408 may be beveled towards the interior of airflow such that the upstream inlet end portion 408 has a slope towards the center of the non-marring nozzle attachment 406. In some embodiments, this slope may be approximately 45 degrees towards the center of the non-marring nozzle attachment 406. The beveling of the upstream inlet end portion 408 may be formed using a sharp tool, including a knife, razor blade, bevel cutter, or other machinery. In some embodiments, the beveling may be performed by a machine, such as a computerized numeric control (CNC) router machine or other types of computer-aided manufacturing (CAM) devices. In other embodiments, beveling of the upstream inlet end portion 408 may be performed through a molding or additive manufacturing process. A perspective view of an embodiment of a beveled nozzle is shown in FIG. 4*c*.

In an embodiment, the non-marring nozzle attachment 406 may be beveled in such a way as to form a thin circular edge on the upstream inlet end portion 408 of the non-marring nozzle attachment 406. This decreases the amount of material in contact with the surface to be cleaned and as such decreases the likelihood that the non-marring nozzle attachment 406 will cause damage to the cleaning surface (e.g., a fine mesh screen of a lint screen). In some embodiments, the upstream inlet end portion 408 may be beveled to a pointed edge or substantially to a point as to minimize surface area in contact with the surface to be cleaned.

In some embodiments, the non-marring nozzle attachment 406 may include multiple slits 410. The slits 410 may be formed on the upstream inlet end portion 408 of the non-marring nozzle attachment 406. The slits 410 may be formed along the wall width, such that the slits 410 extend from an outer surface to the inner surface, and from the upstream inlet end portion 408 towards the hose adapter 404. In some embodiments, the slits 410 are made around the circumference of the non-marring nozzle attachment 406, such that the slits 410 are equally spaced relative to each other. In some embodiments, the slits 410 will be made radially every 0.25" and penetrate the surface of the inlet end by 0.375". The equally spaced slits 410 around the circumference of the non-marring nozzle attachment 406 create fingers 412 that, when pressed against a surface, extend outwards away from the interior of the non-marring nozzle attachment 406. This effect helps distribute to the fingers 412 any force that is applied to the cleaning surface, thus decreasing the likelihood that the non-marring nozzle attachment 406 will cause damage to a lint screen, baseboard trim, or other similar materials. In some embodiments, the fingers 412 have a beveled upstream surface 401 extending between an outer circumferential portion 403 and an inner circumferential portion 405 wherein the outer circumferential portion 403 extends further upstream than the inner circumferential portion 405 of the beveled upstream surface 401. An advantage of this design may be that the material being cleaned and drawn into the vacuum device will not be trapped in the fingers 412. When using the vacuum device, a user may, for example, extend his/her reach with the non-marring nozzle attachment 406 to vacuum lint near the far end of the lint screen while pulling the non-marring nozzle attachment 406 towards the user, cleaning up the lint screen from the far end first to the near end second. In doing so, the user may, by applying force to the non-marring nozzle 400, compress the slits 410 directly contacted with the lint screen, thereby increasing the suction ability of the vacuum as there is less overall flux surface area and a closer fit between the compressed nozzle 400 head to the lint screen surface.

In some embodiments, a non-marring nozzle 400 may be used for practical purposes, as well as for convenience. Attaching and detaching the hose adapter 404 to the non-marring nozzle attachment 406 is relatively easy and may, for example, be performed by a user having arthritic joints, limited range of motion, atrophy affecting the hands, or any combination thereof. Thus, the non-marring nozzle attachment 406 can be replaced with minimal cost and effort.

As mentioned, the non-marring nozzle 400 can be mated to a hose (e.g., the vacuum hose 510 described below in connection with FIG. 5). FIG. 5*a* shows an end view of the inlet end of an embodiment, showing the end housing assembly 502 and non-marring nozzle attachment 504. In one embodiment, the non-marring nozzle attachment 504, when not in use, may be attached to the side of a main body assembly 512. In one embodiment, the non-marring nozzle attachment 504 may be attached to attachment cleat 202 as shown in FIG. 2. The vacuum hose 510 may have many different diameters and be of different lengths according to the needs of the user. In one embodiment, the vacuum hose 510 may be the industry standard 1.25" diameter and may be approximately 28" in length while in the stored condition. The vacuum hose 510 may also be stretchable to approximately 60" in working length.

Figure 5B:
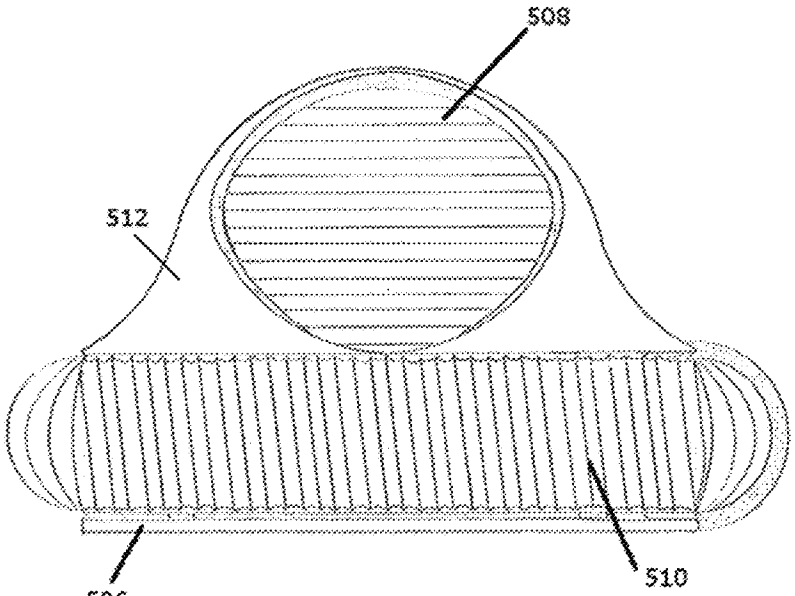
FIG. 5*b* shows an end view of an illustrative example of an embodiment of the vacuum device exhaust end.
Figure 5A:
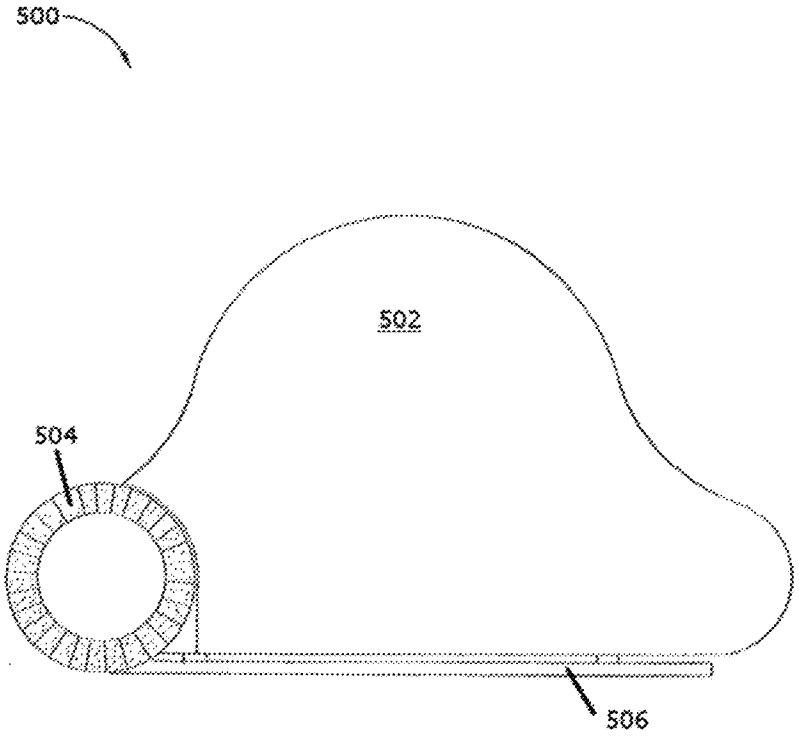
FIG. 5*a* shows an end view of an illustrative example of an embodiment of the vacuum device inlet end.

FIG. 5*b* shows an end view of the exhaust end of an embodiment, showing the directional discharge nozzle 508, the main body assembly 512, the vacuum hose 510, and the base plate 506.

Figures 6A, 6B, 6C:
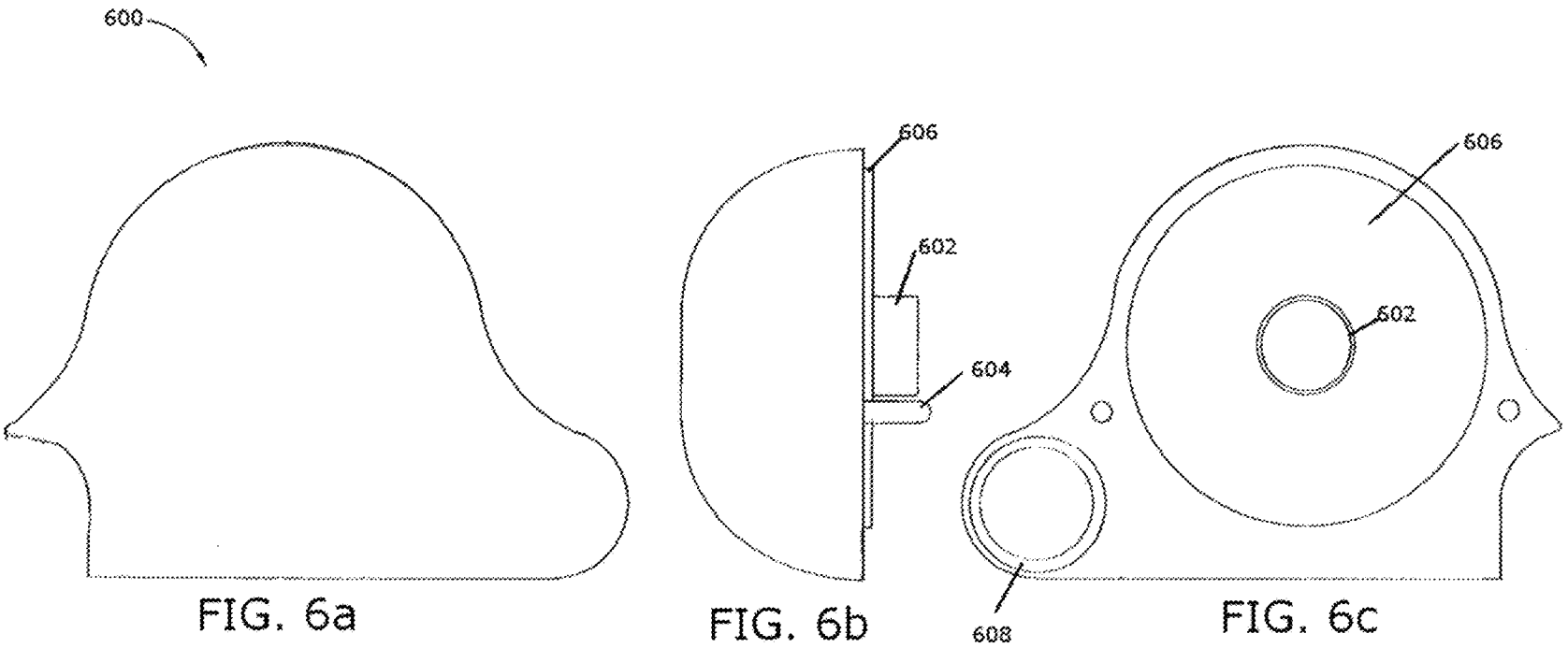
FIG. 6*a* shows an exterior end view of an illustrative example of an embodiment of the end housing assembly.
FIG. 6*b* shows a longitudinal side view of an illustrative example of an embodiment of the end housing assembly.
FIG. 6*c* shows an interior end view of an illustrative example of an embodiment of the end housing assembly.

FIGS. 6*a-c* show different views of the end housing assembly 600. In one embodiment, a function of the end housing assembly 600 is to mate and form a positive connection to the main body assembly of a vacuum device. In some embodiments, this main body assembly may be equivalent to the main body assembly described in connection with FIG. 2. Mating between the male-end filter chamber sleeve 606 and a similarly sized female-end filter port is made by a positive connection. In some embodiments, this female-end filter port may be equivalent to the filter union port 206, as shown in FIG. 2. As such, the male-end filter chamber sleeve 606 may protrude from the end housing assembly and form a friction fit with the female-end filter port. The end housing assembly 600 may be further secured to a main body assembly by use of a filter assembly union sleeve 602, which, in some embodiments, may be equivalent to the filter assembly union sleeve 322 as shown in FIG. 3. In some embodiments, the union of the filter assembly union sleeve 602 with the main body assembly may help hold the circular cardboard plate 318 in place. The end housing assembly 600 may be further secured to a main body assembly by use of latch posts 604, which may be inserted into slots on a main body assembly to form a positive connection. In one embodiment, these slots may be equivalent to the latch assembly ports 704 as shown in FIG. 7.

Figure 7:
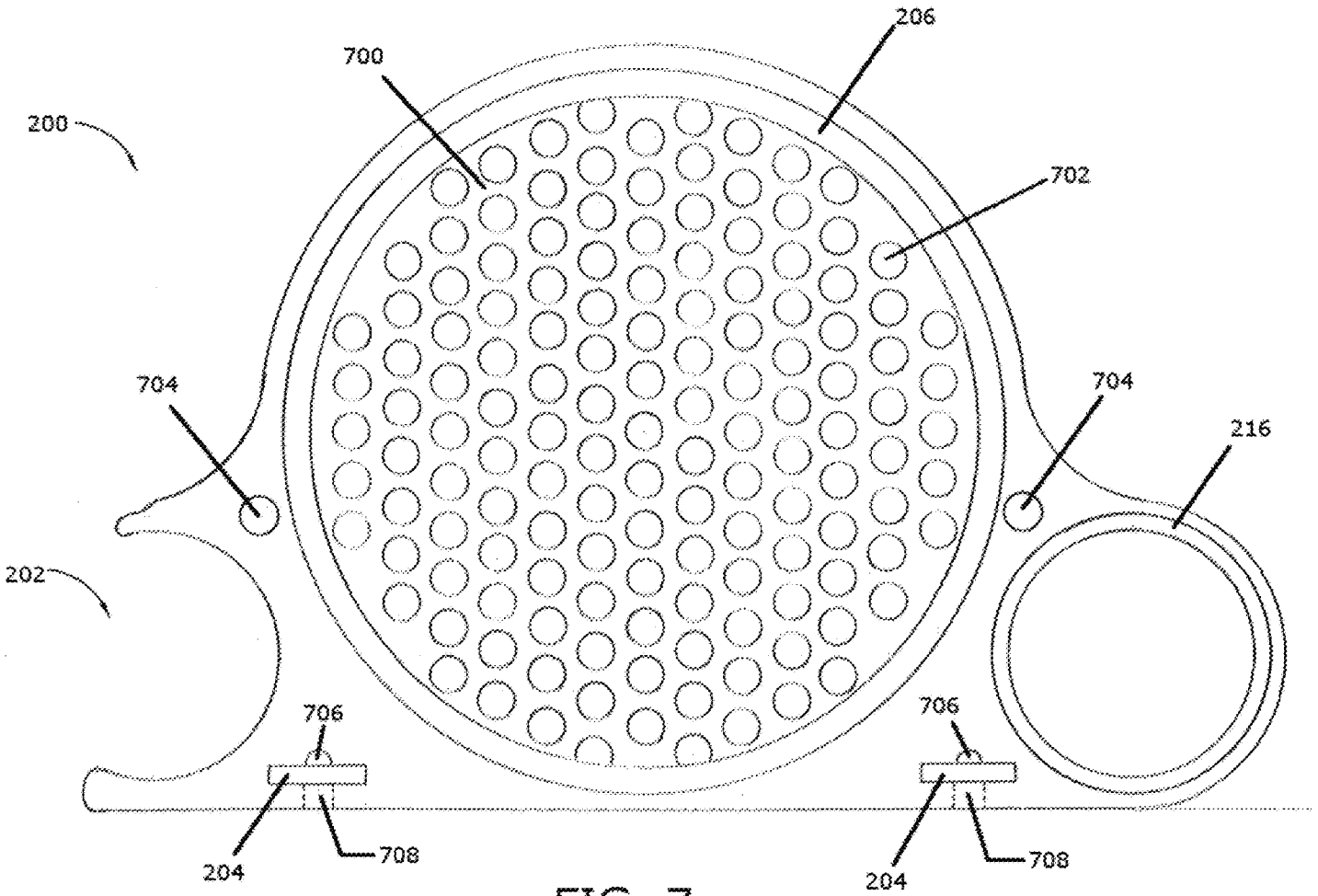
FIG. 7 shows an interior end view of an illustrative example of an embodiment of the main body assembly.

FIG. 7 shows an interior end view of an illustrative example of an embodiment of the main body assembly (e.g., a main body assembly described in connection with FIG. 2), highlighting the diffuser plate 700, latch assembly ports 704, and removal alcoves 706. In one embodiment, the diffuser plate 700 consists of multiple pass-through port holes 702 which allow air to pass through while blocking larger objects and preventing them from entering the impeller. The diameter of each port hole 702 may vary depending on the application of the vacuum device. In some embodiments, the port holes 702 may each be approximately 0.125" in diameter.

Figures 9A, 9B, 9C:
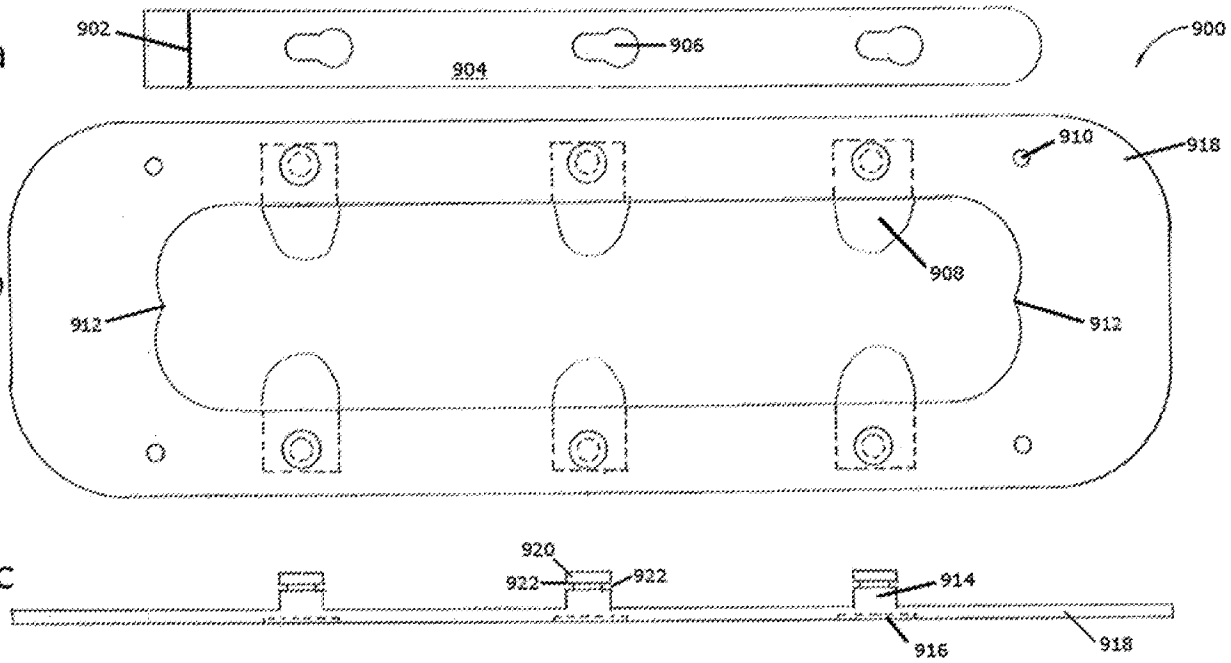
FIG. 9*a* shows a top-down view of an illustrative example of an embodiment of the slide lock spar.
FIG. 9*b* shows a top-down view of an illustrative example of an embodiment of the base plate.
FIG. 9*c* shows a side view of an illustrative example of an embodiment of the base plate.

In an embodiment, slide lock channels 204 may be used to insert a locking spar and mount the vacuum to a base plate assembly. In one embodiment, the locking spar may be equivalent to slide lock spar 904 shown in FIG. 9*a*. The mounting post receiver holes 708 may allow inserts from a base plate assembly to be inserted into the mounting post receiver holes 708 in order to secure the main body assembly 200 to a rigid surface near the desired working area. In some embodiments, this insert may be equivalent to mounting posts 914 of base plate 918 as shown in FIGS. 9*b* and 9*c*. In some embodiment, the mounting post receiver holes 708 may be equivalent to the mounting post receiver holes 1004 shown in FIG. 10.

In some embodiments, the user can remove the main body assembly 200 from a base plate by placing the tip of a screw driver or similar device into the removal alcove 706 located on the surface of the main body assembly 200. The user may then pry the locking spar to release it from a secured position. In one embodiment, an indicator line, such as that shown by indicator line 902 in FIG. 9*a*, can be used to visually indicate that the locking spar has been released. Once the locking spar has been released, the main body assembly 200 may be able to be removed from the inserts of the base plate assembly.

Figure 8:
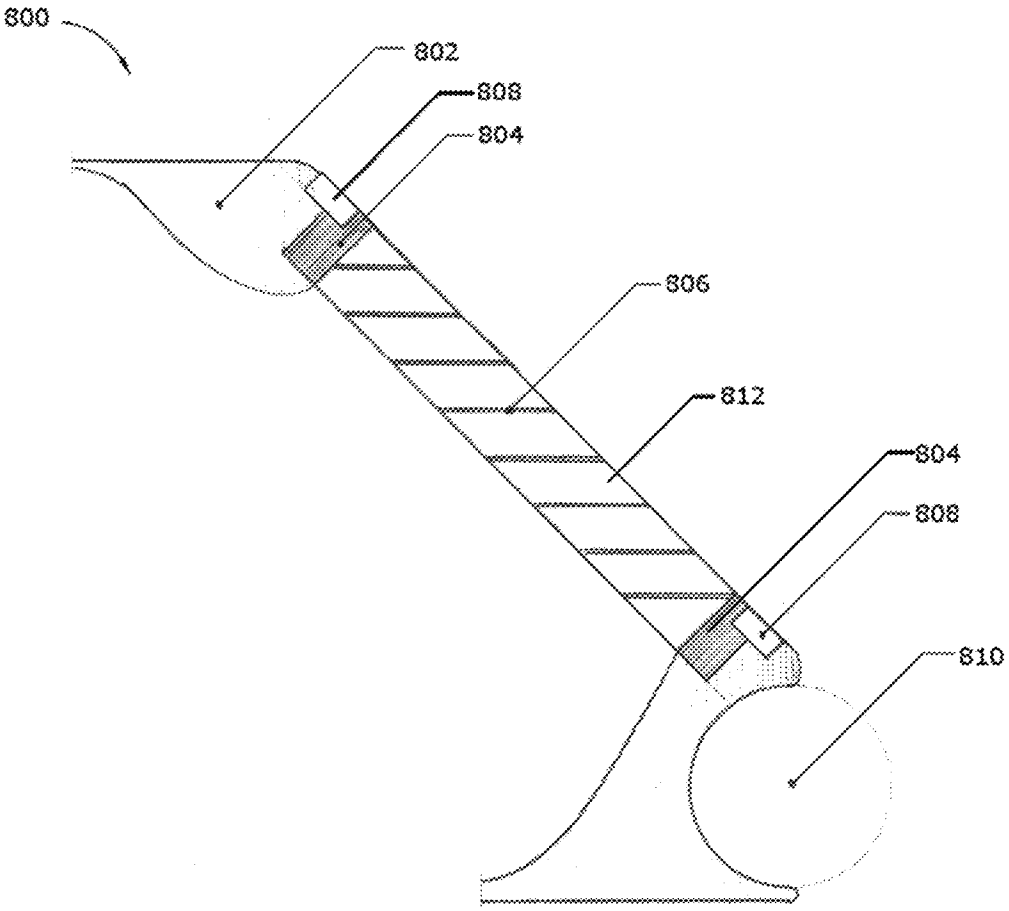
FIG. 8 shows cross section view of an illustrative example of an embodiment of the exhaust discharge port.

Air that passes through diffuser plate 702 continues through to an impeller, motor, and exhaust discharge port 800 is reached. As shown in FIG. 8, the exhaust discharge port 800 comprises the directional discharge nozzle 812, directional discharge nozzle frame 804, louvers 806, retaining ring 808 and a recessed discharge nozzle port in the main body assembly shoulder 802. As shown in FIG. 8, the directional discharge nozzle 812 consists of a round external frame located at the exhaust end of a vacuum device.

In some embodiments, the directional discharge nozzle 812 can be rotated up to 360 degrees providing the ability to direct the exhaust airflow throughout a range that may be axial with or perpendicular to the mounting plane of a vacuum device. In some embodiments, the directional discharge nozzle 812 may also be rotated 45 degrees to either side. In some embodiments, the directional discharge nozzle frame 804 may be made of a hard plastic or thin metal material. A function of the retaining ring 808 may be to secure the directional discharge nozzle 812 in a particular position to direct or reflect the exhaust airflow in a desired direction. In some embodiments, the directional discharge nozzle 812 can be freely rotated by hand and does not need to be locked in a particular position. In one embodiment, the retaining ring 808 is set into a locking position so as to prevent a user from easily removing the directional discharge nozzle 812. The retaining ring 808 may be set against the discharge nozzle frame 804, which may be set adjacent to the main body assembly 802, such that when a vacuum device is OFF there is enough free space between the retaining ring 808 and discharge nozzle shoulders 802 to allow rotation of the directional discharge nozzle 812 by hand. When the vacuum device is ON, pressure from the exhaust airflow pushes the directional discharge nozzle 812 against the retaining ring 808 so as to further directional rotation of the directional discharge nozzle 812.

In an embodiment, the louvers 806 within the directional discharge nozzle 812 may be set at 45 degrees relative the longitudinal top surface of the nozzle frame 804. This is in part a safety function of the device (e.g., to prevent small objects, body parts, electrical cables, etc. from reacing a moving impeller). As such, the louvers in the 45 degree position may be longitudinally parallel to discharge airflow from an impeller/motor chamber. In some embodiments, the louvers 806 may regulate the direction of airflow being exhausted. In some embodiments, this chamber may be equivalent to impeller/motor chamber 122, as shown in FIG. 1. In some embodiments, the louvers 806 may be set to a degree higher or lower than the 45 degree position depending on the need of the user. In some embodiments, the louvers 806 may be set such that their position will not seal the main body assembly 802 from the area external to the exhaust end of the vacuum embodiment. Thus, in this embodiment, at least a minimum amount of discharge airflow will be allowed to pass through the exhaust discharge port 800 when the vacuum device is ON.

A function of the exhaust discharge port 800 is to ensure air flow is exhausted from the vacuum device to the surrounding external area such that minimal back pressure is exerted on the motor. In some embodiments, the diameter of the exhaust discharge port 800 will be larger than the diameter of the non-marring nozzle attachment 406. In this embodiment, a function of the exhaust discharge port 800 is to decrease the discharge velocity of the exhaust air flow. Any back pressure that is exerted on the motor has the effect of limiting air throughput, thus reducing the suction pressure upstream of the motor at the inlet to the non-marring nozzle. The exhaust discharge port 800 ensures a more effective use of the motor. This function may be important because an embodiment of the present disclosure may be to provide a vacuum device that has the convenience in size of a small vacuum but the power benefits of a large vacuum.

Figure 10:
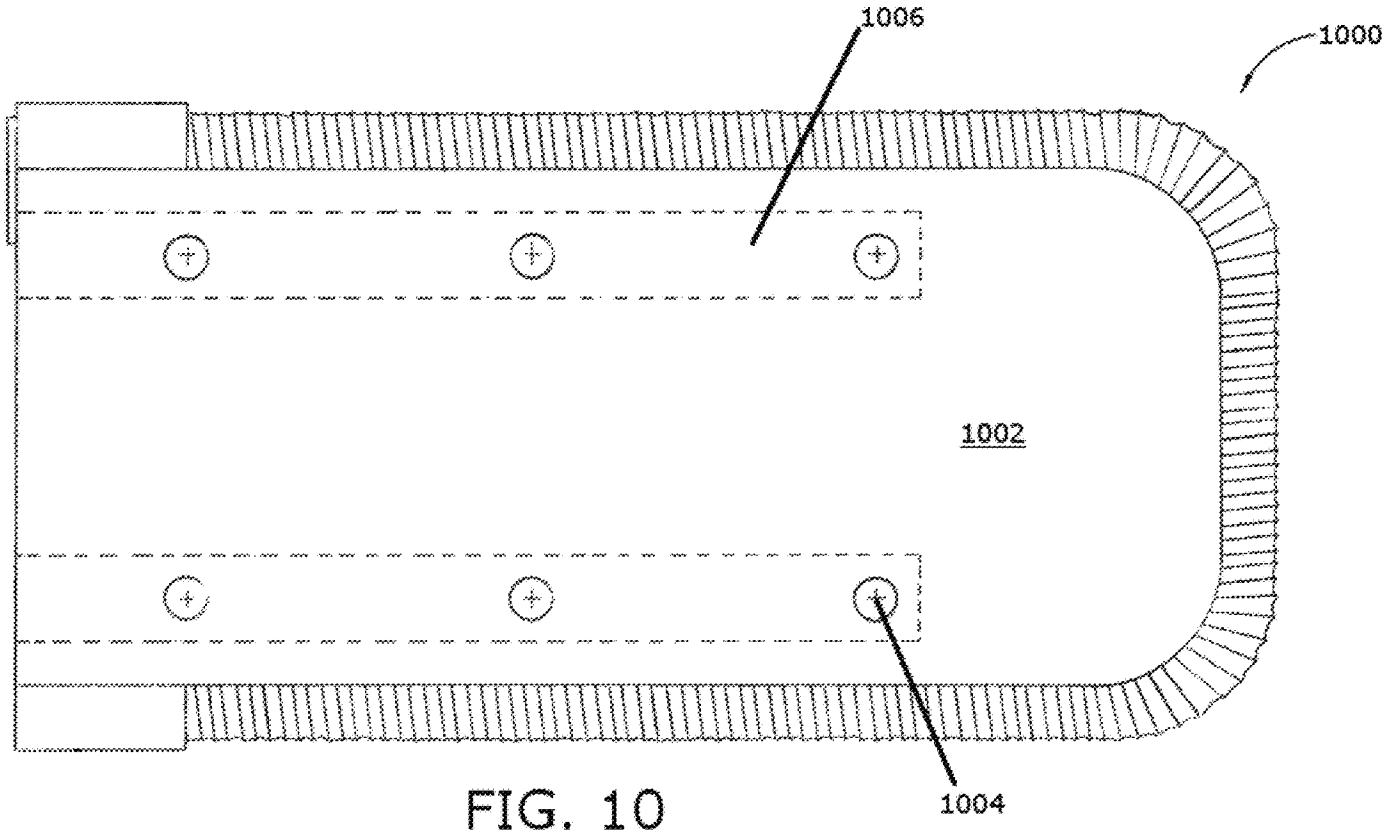
FIG. 10 shows a bottom view of an illustrative example of an embodiment of the main body assembly.

Turning now to FIGS. 9*a-c*, the base plate assembly 900 may allow a vacuum device to be mounted to a rigid surface near a working area in different positions, including a vertical, horizontal, tilted, or inverted position, or any combination thereof. The base plate 918 may be comprised of multiple cylindrical mounting posts 914, each of which may have a formed recess slot 916 located below the mounting post 914. In some embodiments, the base plate may have six cylindrical mounting posts 914, as shown in FIGS. 9*b* and 9*c*. In other embodiments, there may be more or fewer cylindrical mounting posts 914. The head 920 of each of the cylindrical mounting posts 914 may have a diameter sized to fit within a receiver hole into which the mounting post 914 is inserted. In some embodiments, this receiver hole may be sized to fit within the mounting post receiver holes 1004 as shown in FIG. 10. Below the head 920 of each of the cylindrical mounting posts 914 is a mounting post slot 922 used to secure the vacuum device to the base plate 918. In some embodiments, the longitudinal length of the mounting post slot 922 is equal to or slightly larger than the thickness of the slide lock spar 904.

Each cylindrical mounting post 914 may fit into the one of the keyhole slots 906 of a slide lock spar 904, as shown in FIG. 9*b*. In some embodiments, each slide lock spar 904 may comprise multiple keyhole slots 906 along the slide lock spar 904. The slide lock spar 904 may also comprise an indicator line 902 which may be used to indicate to a user when the slide lock spar 904 is locked into a position. The slide lock spar 904 is inserted into a slide lock channel, which may be equivalent to the slide lock channel 204 shown in FIG. 7.

The keyhole slots 906 may be comprised of a double keyhole design, in which both a small diameter area and a large diameter area exist within the key hole slot 906. In one embodiment, the large diameter area may have a diameter equivalent to or larger than the diameter of the object being inserted into it. As such, the insert will not be locked while in this position. In this embodiment, the small diameter area may then have a diameter smaller than the diameter of the object being inserted into it and as such, an insert may be locked into a position by securing it over the small diameter area. A non-limiting example of this may be shown by the keyhole slots 906, mounting posts 914, and mounting post slots 922 shown in FIGS. 9*a* and 9*c*. In this embodiment, the mounting post 914 is first inserted into the large diameter area of a keyhole slot 906. The slide lock spar 904 may then be pushed into the main body assembly towards the smaller diameter area so as to secure the mounting post 914 to the slide lock spar 904. As such, at least part of the mounting post head 920 can rest on top of the small diameter area, which may secure around the mounting post slot 922.

In some embodiments, the base plate 918 is attached to the rigid surface near a working area using adhesive strips. In such embodiments, these adhesive strips may contain adhesive material on both the top and bottom sides of the strip with only part of the adhesive strip containing adhesive material and other parts of the adhesive strip containing non-adhesive material. In some embodiments, the adhesive strips may be equivalent to Command™ Strips made by 3M. In some embodiments, the adhesive end of the adhesive strips may be inserted into a formed recess slot 916 such that part of the adhesive end is encased in the recess 916 and part of the non-adhesive end is not encased in the recess 916. In some embodiments, the non-adhesive end may be equivalent to the adhesive strip tab portion 908, as shown in FIG. 9*b*. Once inserted, the adhesive strips can be secured onto the base plate 918 by pushing down on each cylindrical mounting post 914 towards the base plate 918, thereby securing the top surface of the adhesive end to the base plate 918. The base plate 918 may the be placed onto the desired mounting area and the other bottom surface of the adhesive end can make contact with and be applied to that mounting area rigid surface. With the base plate 918 securely fastened to the rigid surface, the vacuum device may then be secured to the base plate 918. The slide lock spars 904 may be inserted into their respective slide lock channels with their indicator lines 902 still visible. The user may then secure the vacuum device to the base plate 918 by inserting the mounting posts 914 through the large diameter area of the keyhole slots 906 of the slide lock spar 904 and pushing the end of the slide lock spar 904 inward towards the center of the vacuum device until the indicator lines 902 are no longer visible and the slide lock spare 904 is flush with the end surface of the main body assembly. At this point, the vacuum device will then be secured to the base plate 918, which may be mounted to a rigid surface, as previously described.

Once mounted, the base plate 918 may be removed from a particular rigid surface and remounted to a different location or rigid surface. To remove the base plate 918 from a particular surface, the adhesive strips may need to be removed from the recess 916. In some embodiments, removing the adhesive strips from the recess 916 may be accomplished by pulling on the adhesive strip tab portion 908.

The base plate 918 also may be comprised of four mechanical fastener holes 910 and two alignment points 912. The mechanical fastener holes 910 may be used to mount the base plate 918 to a rigid surface using nails, screws, or the like. The alignment points 912 may be used in conjunction with a leveling tool to ensure the base plate 918 is level when secured onto the rigid surface.

FIG. 10 shows a bottom view of the main body assembly 1002 of an embodiment, highlighting a location of the mounting post receiver holes 1004 and slide lock channel 1006. In some embodiments, the mounting post receiver holes 1004 and slide lock channel 1006 may be used to mount a vacuum device 1000 to a rigid surface using a base plate assembly. In some embodiments, this base plate assembly may be equivalent to the base plate assembly 900 shown in FIGS. 9*b* and 9*c*. To secure the vacuum device to the base plate assembly 900, a slide lock spar 904 may be inserted into the slide lock channel 1006, such that the indicator lines 902 are flush with the end of the main housing assembly. IN such a configuration, the large diameter area of the keyhole slots 906 of the slide lock spar 904 may coincide and are aligned with the mounting post receiver holes 1004 located on the base of the vacuum device 1000. The mounting posts 914 may then be inserted into the mounting post receiver holes 1004 and keyhole slots 906. Once inserted, the slide lock spar 904 may be locked in position by pushing the end of the slide lock spar 904 inward towards the center of the vacuum device 1000 until the indicator lines 902 are no longer visible and the slide lock spar 904 is flush with the main body assembly. At this point, the vacuum device 1000 will then be secured to the base plate 918, which may be mounted to a rigid surface, as previously described.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A non-marring nozzle attachment for a vacuum cleaner hose, the non-marring nozzle attachment comprising:

a hollow member comprising a non-marring material with a downstream end and an upstream end, the downstream end being configurable to mate with a vacuum cleaner hose by a friction fit, the upstream end comprising a plurality of slits extending around an inlet of the upstream end of the non-marring nozzle attachment to form a plurality of fingers, wherein said fingers have a beveled upstream surface extending between an outer circumferential portion and an inner circumferential portion, and wherein the outer circumferential portion of the beveled upstream surface extends further upstream than the inner circumferential portion of the beveled upstream surface.

2. The nozzle attachment of claim 1, wherein the non-marring material comprises polyethylene.

3. The nozzle attachment of claim 1, wherein the plurality of slits are equally spaced around a circumference of the inlet of the upstream end.

4. The nozzle attachment of claim 1, wherein the beveled upstream surface forms a thin circular edge or a pointed circular edge on the upstream end of the hollow member.

5. The nozzle attachment of claim 1, wherein the downstream end of the non-marring nozzle attachment is composed of a rigid plastic material.

6. A nozzle for a vacuum cleaner hose, the nozzle comprising:

a hollow member comprising a downstream end and an upstream end, the downstream end configured to mate with a vacuum cleaner hose, the upstream end comprising an outer circumferential portion, an inner circumferential portion, and a plurality of flexible fingers having a beveled upstream surface extending between the outer circumferential portion and the inner circumferential portion, wherein the outer circumferential portion extends further upstream than the inner circumferential portion.

7. The nozzle of claim 6, wherein the upstream end comprises a plurality of slits forming the plurality of flexible fingers, and wherein the plurality of slits are equally spaced around a circumference of the upstream end of the hollow member.

8. The nozzle of claim 6, wherein the beveled upstream surface forms a thin circular edge or a pointed circular edge on the upstream end of the hollow member.

9. The nozzle of claim 6, wherein the hollow member comprises a hose adapter and a nozzle attachment configured to mate with each other, and wherein the downstream end is located on the hose adapter and the upstream end is located on the nozzle attachment.

10. The nozzle of claim 9, wherein the nozzle attachment is composed of a non-marring flexible material.

11. The nozzle of claim 10, wherein the non-marring flexible material comprises polyethylene.

12. The nozzle of claim 9, wherein the hose adapter is composed of a rigid plastic material.

13. The nozzle of claim 9, wherein the hose adapter is permanently affixed to the nozzle attachment.

14. A method for cleaning a lint screen, the method comprising:

attaching a nozzle to a vacuum hose of a vacuum cleaner, wherein the nozzle comprises a hollow member having a downstream end and an upstream end, the downstream end being configured to mate with the vacuum hose, and the upstream end comprising an outer circumferential portion, an inner circumferential portion, and a plurality of flexible fingers having a beveled upstream surface extending between the outer circumferential portion and the inner circumferential portion, the outer circumferential portion extending further upstream than the inner circumferential portion; and applying the upstream end of the nozzle to the lint screen while operating the vacuum cleaner.

15. The method of claim 14, wherein the hollow member comprises a hose adapter and a nozzle attachment, the downstream end being located on the hose adapter and the upstream end being located on the nozzle attachment, and wherein the method further comprises connecting the hose adapter to the nozzle attachment.

16. The method of claim 15, wherein connecting the hose adapter to the nozzle attachment comprises removably mating the hose adapter and the nozzle attachment to each other.

17. The method of claim 16, wherein the hose adapter and the nozzle attachment are removably mated by a tapered friction fit, magnetic attachments, or mechanical clasps.

18. The method of claim 15, wherein the hose adapter and the nozzle attachment connect to each other at a contact surface area having a cylindrical, rectangular, oval, or square hollow form.

19. The method of claim 15, wherein the nozzle attachment is composed of a non-marring, flexible material and the hose adapter is composed of a rigid plastic material.

20. The method of claim 14, wherein the hollow member comprises a hose adapter and a nozzle attachment, and wherein the hose adapter is permanently affixed to the nozzle attachment.

* * * * *